US006663448B1

(12) United States Patent
Davies et al.

(10) Patent No.: US 6,663,448 B1
(45) Date of Patent: Dec. 16, 2003

(54) HYDRAULIC JET PROPULSION APPARATUS FOR BOATS

(75) Inventors: Richard Gwyn Davies, Dunedin (NZ); Barry John Davies, Dunedin (NZ)

(73) Assignee: Contra Jet WJPS NZ Ltd., Dunedin (NZ)

( * ) Notice: Subject to any disclaimer, the term of this patent is extended or adjusted under 35 U.S.C. 154(b) by 0 days.

(21) Appl. No.: 09/043,511

(22) Filed: Mar. 23, 1998

(51) Int. Cl.[7] ..... B63H 11/103
(52) U.S. Cl. ..... 440/47; 440/38
(58) Field of Search ..... 60/221; 440/38, 440/40–43, 47, 67, 68; 114/151

(56) References Cited

U.S. PATENT DOCUMENTS

| | | | | |
|---|---|---|---|---|
| 3,537,585 A | * | 11/1970 | Winter | 210/198.2 |
| 3,782,114 A | | 1/1974 | Broes | 60/221 |
| 4,541,808 A | * | 9/1985 | Ono et al. | 440/42 |
| 4,605,376 A | | 8/1986 | Aschauer | 440/38 |
| 5,800,222 A | * | 9/1998 | Nanami | 440/38 |
| 5,967,864 A | * | 10/1999 | Koyano et al. | 440/38 |

FOREIGN PATENT DOCUMENTS

| | | |
|---|---|---|
| GB | 1316426 | 5/1973 |
| WO | WO94/08845 | 4/1994 |

* cited by examiner

*Primary Examiner*—Sherman Basinger
(74) *Attorney, Agent, or Firm*—Jacobson Holman PLLC

(57) ABSTRACT

A water jet propulsion unit including an intake section, a pump section having a pair of counter-rotating impellers mounted side by side on parallel driving shafts in separate cylindrical passages through the pump section and a mixing discharge section ending in a discharge nozzle. The mixing/discharge section is adapted to converge the flows of water discharge from the impellers to neutralise non-axial flow components from one impeller by non-axial flow components from the other impeller to maximise axial flow out of the mixing/discharge section. The unit may be operated as a high mass/low pressure unit or low mass/high pressure unit.

19 Claims, 4 Drawing Sheets

HYDRAULIC JET PROPULSION APPARATUS FOR BOATS

TECHNICAL FIELD

This invention relates to a water jet propulsion unit for use in water-borne craft,

BACKGROUND ART

Water jet propulsion units have hitherto been of two main types: those in which axial flow is achieved by the use of stators or straightening vanes, being of either axial or mixed-flow configuration; and those in which axial flow is achieved with or without stator assistance, by the use of counter-rotating impellers, also being of axial of mixed-flow configuration.

The use of counter-rotating impellers is described in our PCT application WO94/08845 whereby large efficiency gains are achieved by providing a low pressure, high mass design, utilising a pair of in-line impellers fixed to co-axial shafts and a nozzle throttling device. In the designs described in WO94/08845 the radial component issuing from the upstream impeller is eliminated by mechanically driving the down-stream impeller, which is of opposite but similar pitch, in the opposite direction.

The prior art references in WO94/08845 all describe two in-line impellers counter-rotating about the same axis.

One disadvantage of in-line impellers is that the driving means for such impellers necessarily require either complex gearing in a common housing such as in DE 3,942,672 or concentric shafts such as are shown in WO94/08845. It would be desirable to be able to provide side by side impellers having separate driving shafts with more straight forward bearing mountings than with the in-line configuration.

In order to increase the rate of flow through a jet propulsion unit which has axial in line impellers it is necessary either to increase the speed of rotation of the impellers or else to increase their diameter. It would be advantageous to be able to increase the rate of flow without doing either.

It is an object to go some way towards achieving these desiderata or at least to offer the public a useful choice.

BRIEF DESCRIPTION OF THE INVENTION

Accordingly the invention may be said broadly to consist in a water jet propulsion unit comprising:

an intake section, a pump section having a pair of separate cylindrical passages therethrough, and a mixing/discharge section ending in a discharge nozzle, the sections being in smooth commnunication with each other, a pair of impellers in said pump section rotatable in opposite directions on parallel axes in a substantially side by side configuration, one within each said cylindrical passage, said mixing /discharge section being adapted to converge the flows of water being discharged from said impellers in a manner which substantially neutralises non-axial flow components from one said impeller by means of non-axial flow components from the other said impeller and maximises axial flow out of said mixing/discharge section.

Preferably said impellers are axial flow impellers.

In one embodiment said mixing/discharge section is substantially oval in cross-section at its plane of intersection with said pump section and converges in a downstream direction to be substantially circular in cross-section at said nozzle.

The term "oval" for the purposes of this specification means a closed geometric figure consisting of opposed half circles of equal radii joined by parallel straight lines tangential to each said half circle.

Preferably there is provided at the upstream end of said mixing/discharge section a common wall between the streams of water discharged from said pump section, the sides of said common wall converging into an opening beginning at a point intermediate said parallel axes and extending in a downstream direction in smooth curves to intersect with opposite walls of said mixing/discharge chamber at points in the same plane orthogonal to said parallel axes.

In one embodiment said intake section is divided into sections, one section leading to each separate passage through said pump section.

Preferably, when said intake section is so divided, there is provided a flow deflecting means in said intake chamber to equalise the flow of water entering each of said separate passages through said pump section.

In one embodiment said impellers are mounted on drive shafts to be driven by a single driving means.

In another embodiment said impellers are mounted on drive shahs to be driven by separate driving means.

Preferably the cross-sectional area of said discharge nozzle is adjustable.

Preferably the blades of said impellers are of equal but opposite pitch.

Preferably the peripheral blade angles of said impellers are in the range of about 25° to about 40°.

In one embodiment the unit is calibrated to operate in a high pressure/low mass mode.

In another embodiment the unit is calibrated to operate in a low pressure/high mass mode.

In another alternative embodiment there are two pairs of separate passages through said pump section and two pairs of counter-rotating side by side impellers mounted therein.

In one embodiment said intake section is divided into four sections, one section leading to each separate passage through said pump section.

BRIEF DESCRIPTION OF THE DRAWINGS

FIG. 5 is the cross-section shown by arrows FIG. 5—FIG. 5 in. FIG. 1.

BEST MODE FOR CARRYING OUT THE INVENTION

Construction

Figure 1:
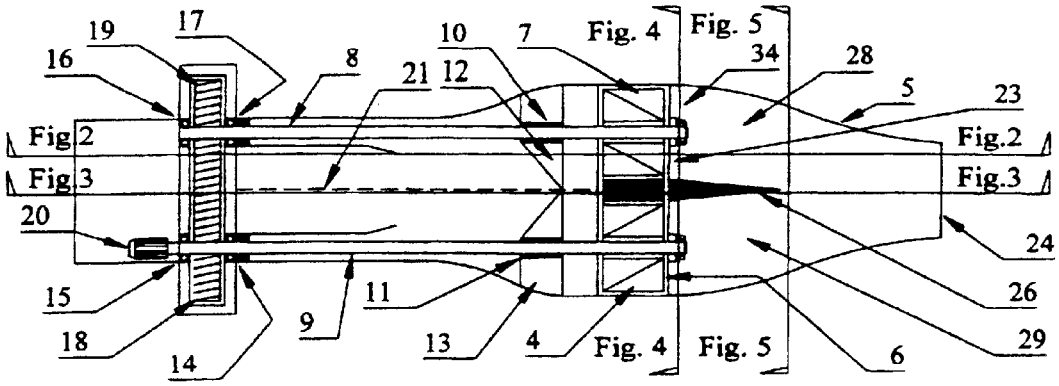
FIG. 1 is the top longitudinal section of a unit according to the invention shown by the arrows FIG. 1—FIG. 1 in FIGS. 2 and 3.

The unit comprises an intake section 1, a pump section 3 and a mixing/discharge section 5. There are a pair of impellers 6 and 7 within pump section 3. Mixing/discharge section 5 ends with nozzle 24. Extending from outside intake section 1 through to pump section 3 is a gear-shaft system 8, 9, 18, 19 to provide for rotation of the impellers 6 and 7.

In a modification of the embodiment just described the intake section 1 is provided with a vertical partition 21, shown as a broken line, extending longitudinally from the intake opening 2 to the pump section 3 so that separate intake water streams are provided for each impeller 6 and 7.

The partition 21 can be further modified by providing an adjustable, hinged proportioning flap 27, shown as a broken line at the intake 2 end, which provides a means whereby small adjustments can be made to ensure that the impellers 6 and 7 have a balanced flow. The flap 27 may be manually or otherwise controlled by the use of a pressure or flow sensor coupled to a remotely placed electronic controller.

Intake opening 2 is positioned in the bottom of a boat. In the embodiment shown the intake section 1 and the pump section 3 are joined in a continuous casing and the top 4 of pump section 3 is substantially flat. It is preferable that pump section 3 comprises a separate component sandwiched between intake section and mixing/discharge section 5 by means of flanges and bolts. Within pump section 3 are two cylindrical passages 22 and 23, each of which provides a close fitting and separate enclosure for the impellers 6 and 7 which are in turn fixed to the separate driving shafts 8 and 9. The driving shafts 8 and 9 are each supported in water-lubricated bearings 10 and 11 which are mounted inside two sets of three-vane supports 12 and 13, fixed to the inside of the intake section 1. The vanes 12 and 13 are of thin section and aligned with the incoming water flow so as to minimise turbulence. Each driving shaft 8 and 9 is rotatably mounted in water lubricated bearings 10 and 11 within intake section 1, and in bearings 14, 15, 16 and 17 at their driven ends outside the intake section 1. The driving blades on each impeller 6 and 7 are of opposite pitch. The peripheral blade angles of the blades of the impellers in a unit calibrated for low pressure operation are typically in the range of 25–40 degrees.

Two meshed gears 18 and 19 of equal diameter are fixed to the ends of shafts 8 and 9. Shaft 9 is extended and has a splined end 20 designed to accept a drive flange to be driven by a driving engine.

It is not intended that the scope of the invention is to be limited in the means used for the rotation of the driving shafts 8 and 9. Driving shafts 8 and 9 may be rotated using a variety of means which could include, for example, two engines coupled separately and directly to the ends of the driving shafts 8 and 9, or an engine coupled system which could include the use of chains, gears, sprockets or belts or combinations thereof. The speed of the impellers 6 and 7 can be increased or decreased by altering the drive ratios of the transmission system. This can be done by introducing a third gear which would mesh with either of gears 18 and 19, and be driven directly by the driving engine. The control of the speed of the impellers 6 and 7 permits the apparatus to be fine tuned to its point of maximum hydraulic efficiency.

The mixing/discharge section 5 is preferably a separate component. It has a flange at its upstream end which is bolted to a corresponding flange at the downstream end of pump section 3.

At the upstream end 34 of the mixing/discharge section 5 there is provided a short common wall 26 which converges into opening 30 at the trailing edge of wall 26. The centre point 31 of opening 30 extends along mid-lines 32 and 33 to sharp intersection points 25 and 35 with the bottom surface 38 and the top surface 36 of the casing of discharge/mixing section 5.

Figure 4:
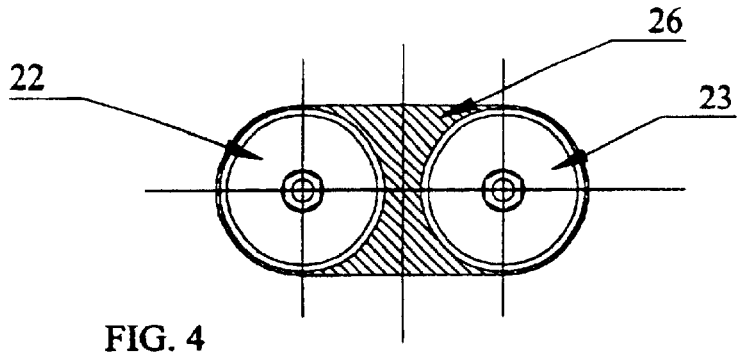
FIG. 4 is the cross-section shown by arrows FIG. 4—FIG. 4 in FIG. 1.
Figure 5:
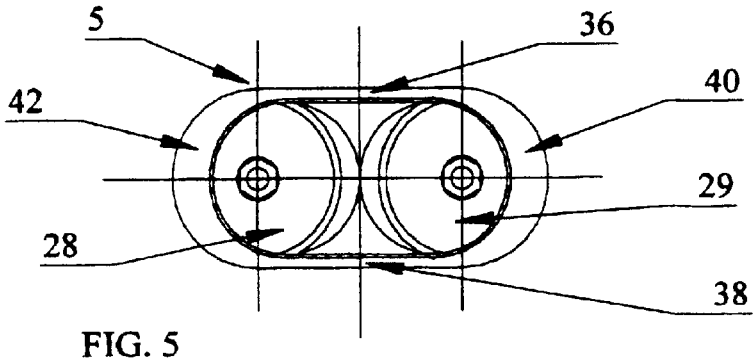

In the preferred embodiment illustrated, particularly in FIGS. 4 and 5, the cross-section of mixing/discharge section 5 at its intersection 34 with the pumping section is substantially oval in cross-section. The straights of the oval being the top 36 and the bottom 38 surfaces and the curves of the oval being the side surfaces 40 and 42. As the section moves downstream from the intersection 34 to the nozzle 24 the lengths of the straights and the diameters of the curves progressively decrease until in the embodiment illustrated they merge as a single circular cross-section at nozzle 24. Nozzle 24 does not need to be circular in shape. It can be slightly oval as well.

The shape of the nixing/discharge section may vary slightly so long as there is a continuous smooth converging wetted surface from the pump section 3 to the nozzle 24. In the plan view in FIG. 1 the curves of the side wall have swept "S" shapes while in the embodiment in FIG. 8 the shape is more flattened conical to cylindrical.

Figure 2:
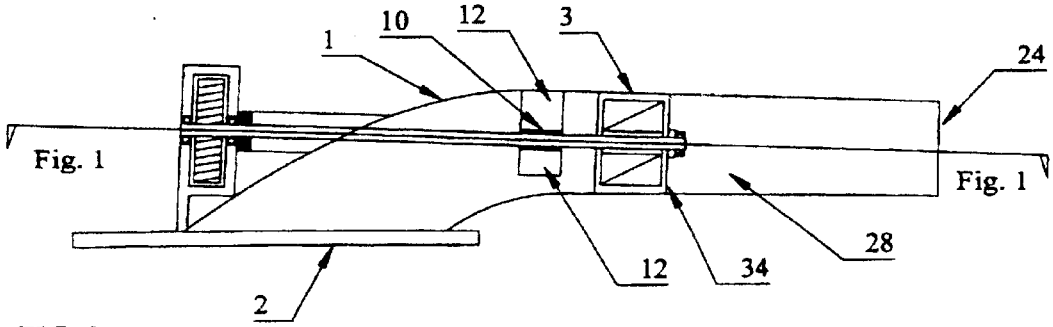
FIG. 2 is the side longitudinal section shown by the arrows FIG. 2—FIG. 2 in FIG. 1.
Figure 3:
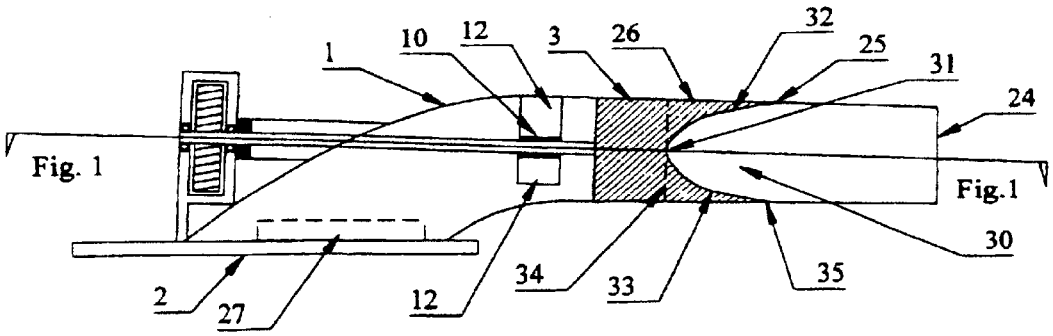
FIG. 3 is the side longitudinal section shown by the arrows FIG. 3—FIG. 3 in FIG. 1.
Figure 7:
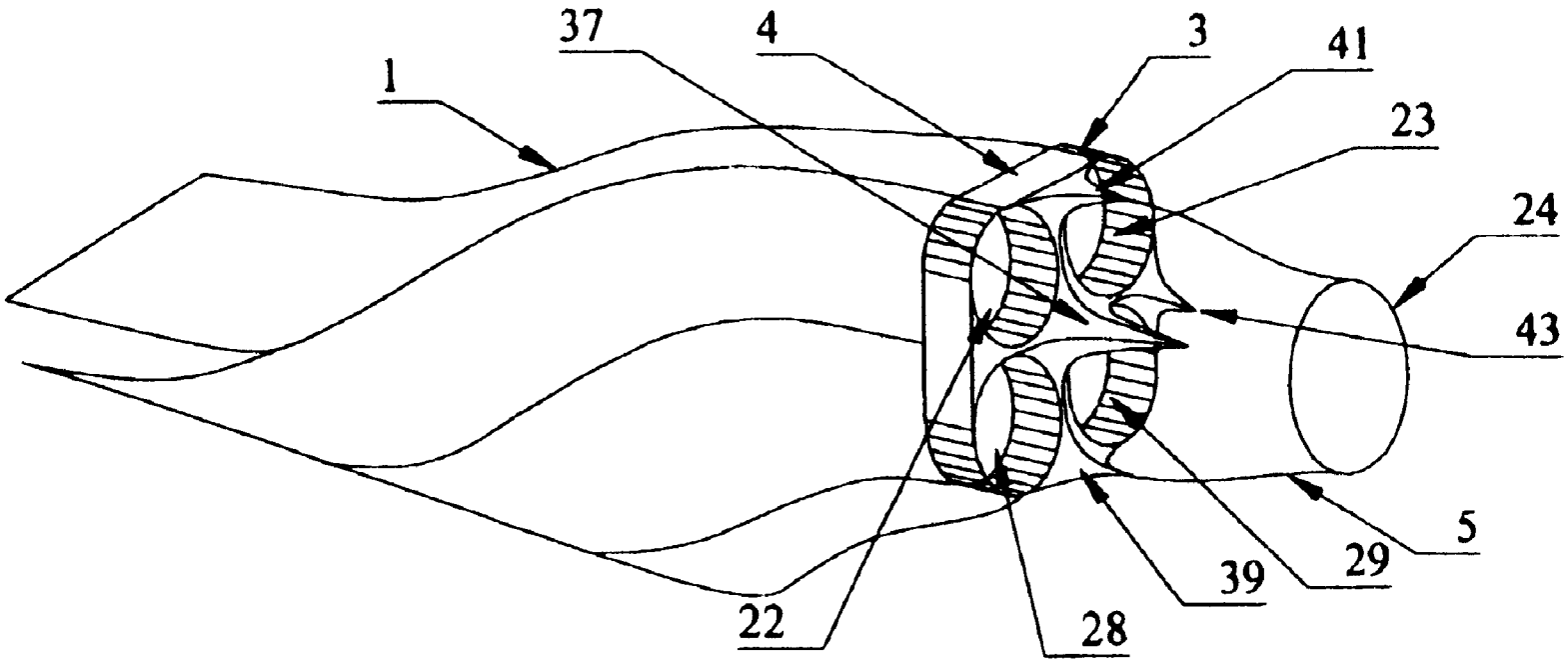
FIG. 7 is a isometric schematic view of a unit incorporating two pairs of impellers in parallel stacked arrangement showing the mixing/discharge section with the casing removed.

An embodiment having four parallel impellers is illustrated schematically in FIG. 7. The intake section I is similar in shape to that in FIGS. 1 to 3. The intake section 1 may also be divided into sections as described with reference to the other embodiment, there being two or more passages leading to the four impellers. There may also be provided flow equalisers of the same construction as flap 27 in FIG. 3.

In the pump section 3 there are two pairs of cylindrical passages, 22 and 23 on top, and 28 and 29 below. In each passage is an impeller of the type already described. The impellers in passages 22 and 23 counter-rotate with respect to each other. The impellers in passages 28 and 29 counter-rotate with respect to each other as well.

Figure 6:
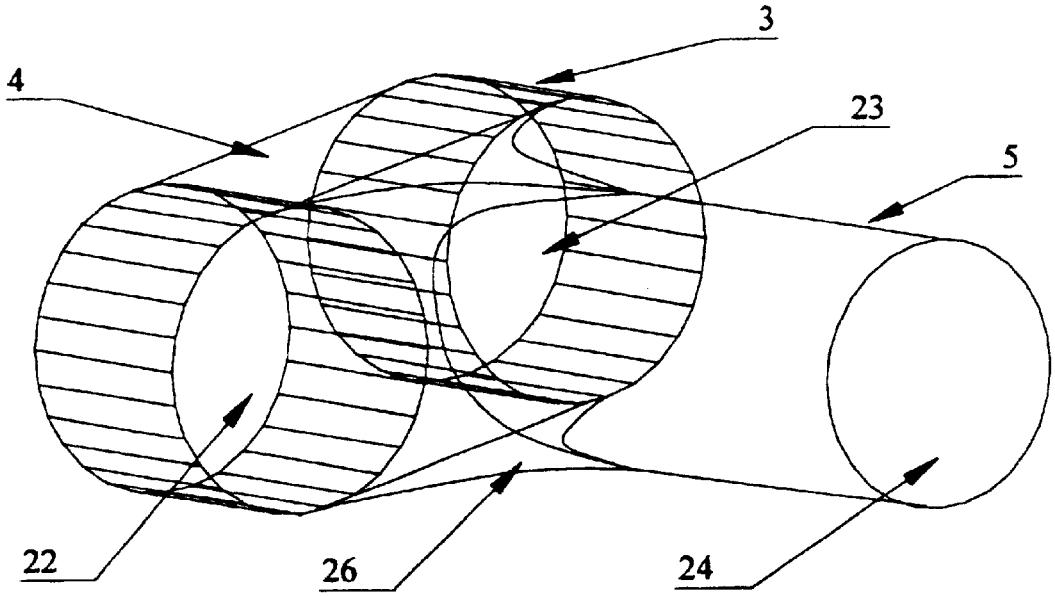
FIG. 6 is a schematic isometric view of the mixing/discharge section of a unit according to the invention with the casing removed.

The shape of mixing/discharge chamber 5 converges in cross-section from being substantially square with rounded corners at the upstream end to being substantially circular at nozzle 24. It has a central converging surface 37, bottom 39, top 41 and side 43 converging surfaces similar in shape to common wall 26 in FIG. 6.

Nozzle 24 is the same in construction as that described with reference to FIGS. 1 to 6 and 8.

Operation

The operation of the unit upstream of the pump section is substantially the same as in a conventional unit. Water is drawn in intake opening 2 by impellers 6 and 7. Where a partition 21 is provided there may be small differences in flow rate between the two compartments defined by the partition 21. These are detected by the sensor provided and the flap 27 pivoted appropriately to divert more flow to the compartment in deficit.

The peripheral blade angles of impellers 6 and 7 are preferably set at angles in the range of 25–40 degrees. This ensures that the impingement, or deflection angle, for each helically moving flow out of passages 22 and 23 is as high as possible, being ideally in the range of 40° to 45° so that the resultant axial flow is achieved with minimal radial losses and reduced turbulence. Typically the impellers 6 and 7 will have peripheral blade velocities in the range 25–55 meters/second.

Figure 8:
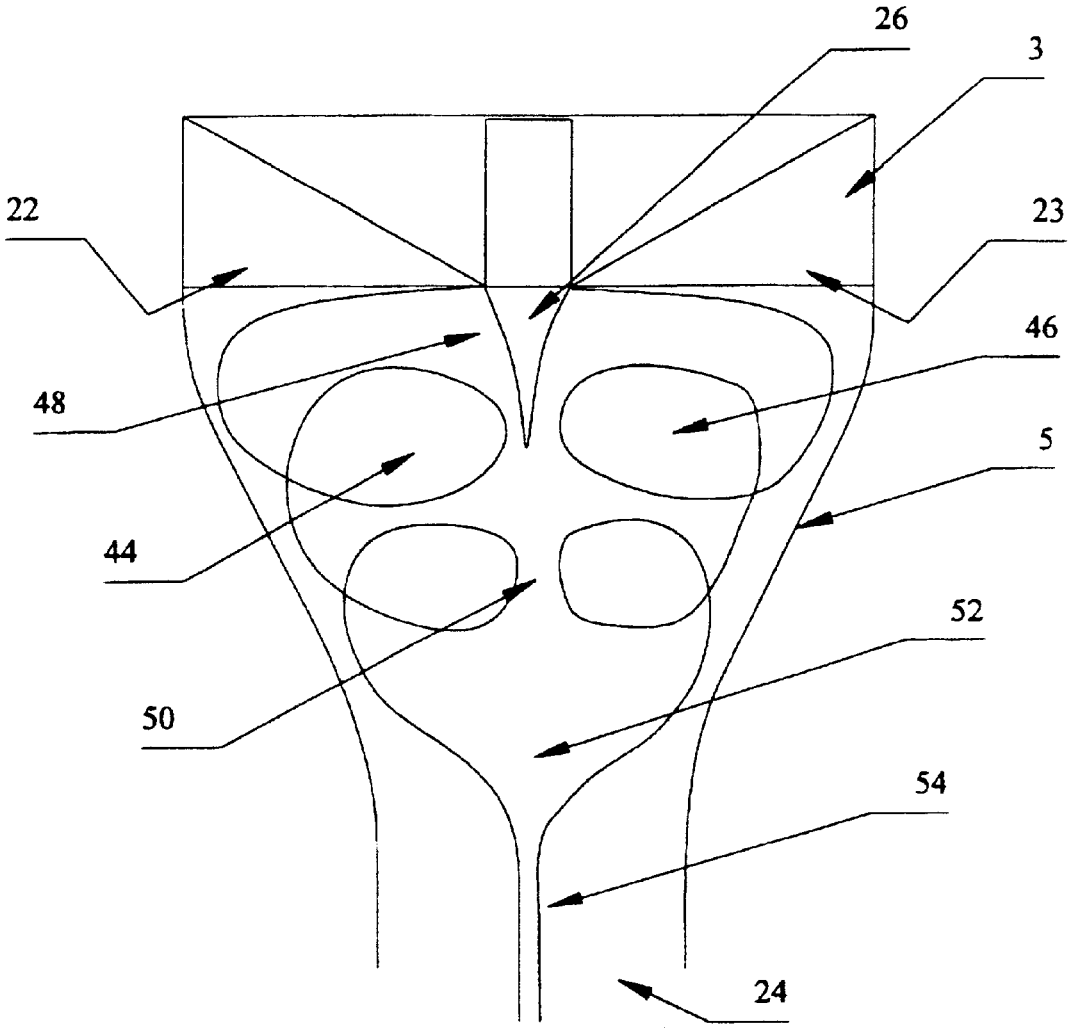
FIG. 8 is a top longitudinal sectional view as in FIG. 1 illustrating schematically the mixing the two flows of water from the two impellers.

The mixing of the two flows emerging from passages 22 and 23 is illustrated schematically in FIG. 8. The two helical flows 44 and 46 leave the impellers 6 and 7 at the end of the pump section 3. The oppositely helically rotating flows 44 and 46 begin to impact on each other at 48 and continue to mix/impact progressively until they are discharged as an axial flow 54 from the nozzle 24. The non-axial components of each flow are progressively cancelling each other out at points 50 to 52 and are substantially axial by the time they get to point 52 as illustrated in FIG. 8. The substantially axial flow 54 out of the nozzle thus maximises the reaction thrust necessary for propulsion.

The apparatus may be calibrated to operate as a high pressure device but would normally be operated as a low pressure device as described in WO 94/08845. One way of achieving pressure regulation is with a throttling device fixed to the outside perimeter of the nozzle 24 outlet. This allows pressure conditions inside the unit to be varied in the range of about 0–276 kPa. (0–40 pounds per square inch) and assists in pump priming at start up.

Advantages

The prior art referred to in WO94/08845 all describes in-line impellers counter-rotating about the same axis. In these devices the overall diameter/pitch of the upstream impeller is increased or decreased according to the hydraulic/power requirements desired of the device.

In apparatus of this invention two axial flow impellers of opposite but identical pitch are arranged in side by side fashion on two parallel driving shafts. Water is drawn in through an intake, as for the above designs, and passes through the impellers, thence into a mixing-discharge section. The mixing/discharge section contains no stators.

The effect of this is that two counter-rotating helically moving streams of water leave the two impellers and move in parallel into the mixing/discharge section where they are forced together within the constricting walls of this section. The result of this is that the non-axial components of each flow are cancelled out so that axial flow is achieved in order to maximise reaction thrust. Unlike the axial in-line designs, however, the use of impellers in side by side arrangement allows for greater increases in flow through the device without having to greatly increase the diameter of the impellers, thereby greatly reducing their cost of manufacture. The provision in a preferred embodiment of side by side impellers having separate driving shafts allows for more straight forward bearing mountings than with the in-line or axial configurations.

The unit of this invention is not limited to the use of axial flow impellers. It is possible to use partial or full mixed flow impellers instead. The disadvantages of mixed flow impellers is that they are of greater diameter than the equivalent axial flow impellers and they require the presence of stators downstream of the impellers.

Other embodiments within the scope of the appended claims will be apparent to those skilled in the art.

What is claimed is:

1. A water jet propulsion unit comprising:

an intake section, a pump section having a pair of separate cylindrical passages therethrough, and a mixing/discharge section ending in a discharge nozzle, the pump section and the mixing/discharge section being in smooth communication with each other, and a pair of impellers in said pump section rotatable in opposite directions on parallel axes in a substantially side by side configuration, one within each said cylindrical passage, said mixing/discharge section converging the flows of water being discharged from said pair of impellers in a manner which substantially neutralises non-axial flow compounds from one said impeller by non-axial flow components from the other said impeller and maximises axial flow out of said mixing/discharge section.

2. The jet propulsion unit as claimed in claim 1, wherein said impellers are axial flow impellers.

3. The jet propulsion unit as claimed in claim 2, wherein the blades of said impellers are of equal but opposite pitch.

4. The jet propulsion unit as claimed in claim 3, wherein the peripheral blade angles of said impellers are in the range of 25 to 40°.

5. The jet propulsion device as claimed in claim 3, wherein the peripheral blade angles of said axial flow impellers are in the range of about 10 to 25°.

6. The jet propulsion unit as claimed in claim 1, wherein said mixing/discharge section is substantially oval in cross-section at its plane of intersection with said pump section and converges in a downstream direction to be substantially circular in cross-section at the outlet of said mixing/discharge section.

7. The jet propulsion unit as claimed in claim 1, wherein there is provided at the upstream end of said mixing/discharge section a common wall between the streams of water discharged from said pump section, the sides of said common wall converging into an opening beginning at a point intermediate said parallel axes and extending in a downstream direction in smooth curves to intersect with opposite walls of said mixing/discharge chamber at points in the same plane orthogonal to said parallel axes.

8. The jet propulsion unit as claimed in claim 1, wherein said intake section is divided into sections, one section leading to each of said separate passage through said pump section.

9. The jet propulsion unit as claimed in claim 8, wherein there is provided a flow deflector in said intake chamber to adjust the flow of water entering each of said separate passages through said pump section.

10. The jet propulsion unit as claimed in claim 1, wherein said impellers are mounted on drive shafts to be driven by a single drive.

11. The jet propulsion unit as claimed in claim 1, wherein said impellers are mounted on drive shafts to be driven by separate drives.

12. The jet propulsion unit as claimed in claim 1, wherein the cross-sectional area of said discharge nozzle is adjustable.

13. The jet propulsion unit as claimed in claim 1, wherein the unit is calibrated to operate in a high pressure/low mass mode.

14. The jet propulsion unit as claimed in claim 1, wherein the unit is calibrated to operate in a low pressure/high mass mode.

15. The jet propulsion unit according to claim 1, wherein the unit is calibrated to operate in one of a low pressure/high mass mode and a high pressure/low mass mode.

16. A water jet propulsion unit comprising:

an intake section, a pump section having two pairs of separate cylindrical passages therethrough, and a mixing/discharge section ending in a discharge nozzle, the pump section and the mixing/discharge section being in smooth communication with each other, two pairs of impellers in said pump section rotatable in opposite directions on parallel axes in a substantially side by side configuration, one impeller within each said cylindrical passage, said mixing/discharge section converging the flows of water being discharged from said two pairs of impellers in a manner which substantially neutralises non-axial flow compounds from one said impeller by non-axial flow components from another said impeller and maximises axial flow out of said mixing/discharge section.

17. The jet propulsion unit as claimed in claim 16, wherein the two pairs of counter-rotating impellers are in parallel, one pair being arranged on top of the other.

18. The jet propulsion unit as claimed in claim 16, wherein the two pairs of counter-rotating impellers are mixed flow impellers.

19. The jet propulsion unit as claimed in claim 18, wherein one pair of impellers is positioned on top of the other.

* * * * *